US006125493A

United States Patent [19]

Daw

[11] Patent Number: 6,125,493

[45] Date of Patent: Oct. 3, 2000

[54] COMBINATION BARBECUE GRILL BRUSH AND MITT

[76] Inventor: Mark S. Daw, 1644 Lake Shore Dr., Michigan City, Ind. 46360

[21] Appl. No.: 09/039,291

[22] Filed: Mar. 12, 1998

[51] Int. Cl.[7] ..... A47L 13/12

[52] U.S. Cl. ..... 15/111; 15/160; 15/227

[58] Field of Search ..... 15/111, 160, 227, 15/236.01, 236.02

[56] References Cited

U.S. PATENT DOCUMENTS

| | | |
|---|---|---|
| 830,016 | 9/1906 | Sims . |
| 1,096,204 | 5/1914 | Taggert . |
| 1,330,406 | 2/1920 | Stricklin . |
| 1,747,097 | 2/1930 | Young . |
| 2,352,010 | 6/1944 | Robbins . |
| 2,436,507 | 2/1948 | Ellwood . |
| 2,941,214 | 6/1960 | Michael . |
| 3,116,502 | 1/1964 | Gerber . |
| 3,800,354 | 4/1974 | Stephens . |
| 4,203,495 | 5/1980 | Crownover . |
| 4,538,320 | 9/1985 | Batt . |
| 4,683,592 | 8/1987 | Strongwater . |
| 4,748,711 | 6/1988 | Markus . |
| 4,751,747 | 6/1988 | Banks et al. . |
| 5,479,673 | 1/1996 | Carton . |

*Primary Examiner*—Robert J. Warden, Sr.
*Assistant Examiner*—Jennifer McNeil

[57] ABSTRACT

A combination barbecue grill brush and mitt includes a barbecue grill brush and a heat-protective mitt. The grill brush comprises a body having a hand-fitting hand grip (10), an intermediate section (12), and a head section (14). The head section comprises a scraping edge (20) and a bristled surface (22). The intermediate section is angled so as to dispose the head below the hand grip. A mitt (16) is positioned about the hand grip, the mitt including a first end (28) having an opening to permit insertion of a hand of a user, a second end (30) having an opening for insertion of the hand grip of the grill brush, and an optional inner lining (24). The hand grip is secured within the mitt with a rivet (18) such that the mitt's material is gathered around and hugs the intermediate section to substantially prevent hot gases, sparks, and ash from entering the mitt, and an optional reinforcing collar (32) to provide improved attachment of the second end to the intermediate section and further prevent hot gases, sparks, and ash from entering the mitt.

8 Claims, 6 Drawing Sheets

COMBINATION BARBECUE GRILL BRUSH AND MITT

BACKGROUND

1. Field of Invention

This invention relates to brushes, specifically to an improved hand-held brush for cleaning barbecue grills and the like.

2. Description of Prior Art

Hand-held brushes for removing cooked-on meat, vegetable matter, grease, oils, and the like from barbecue grills have been developed in convenient and efficient forms. A widely available form of barbecue grill brush is comprised of a one-piece hard plastic body. One end serves as a hand grip. From the hand grip, the piece narrows slightly in width and angles downward forming an intermediate section. From the intermediate section, the piece terminates in a flat, wide rectangular head section. Anchored to the underside of the head section are rows of stiff brass bristles. Embedded in and extending from the end of the head is a scraper, which is a thin, flat, narrow piece of steel with semicircular shaped notches cut from each corner. These features enable the user to scrape or brush off cooked-on food matter. The intermediate section is angled such that the head section is disposed below the hand grip. This design feature increases clearance between the user's hand and the grill to prevent the user's hand from contacting the hot grill surface.

Other styles of barbecue grill brushes are available. They vary in size, shape, and materials of construction. Some are equipped with scrapers and the handles vary in length. To various degrees of success, all styles of barbecue grill brushes accomplish the task of cleaning grill surfaces.

However, grill surfaces are more thoroughly and efficiently cleaned when hot. The major disadvantage of prior art barbecue grill brushes is that they do not protect the user's hand from the intense heat that charcoal and gas grills generate. Consequently, the user risks burn injuries to his or her hand and forearm. Users also risk singeing the hair off their knuckles and band. Another disadvantage is that the heat limits the amount of time the user can tolerate brushing the grill resulting in incomplete cleaning or complete cleaning only after multiple attempts. Brushes with longer hand grips enable the user to grasp the hand grip farther away from the heat, but at the sacrifice of leverage. The disadvantage is that the longer handle requires more strength to apply the same amount of pressure to clean the grill surface. Long handles also reduce maneuverability.

OBJECTS AND ADVANTAGES

Accordingly, several objects and advantages of my combination barbecue grill brush and mitt are:

a) it protects the user's hand from the intense radiant and convective heat generated by charcoal and gas grills;

b) it eliminates singeing the hair on the user's knuckles and hand;

c) it greatly reduces the potential for burning the user's hand and forearm by contacting hot surfaces;

d) it allows the user adequate time to comfortably and thoroughly clean the entire grill surface; and e) it enables the user to grip the hand grip closer to the head section so that more downward force can be exerted on the brush.

Other objects and advantages are:

a) it protects the user's hand and forearm from sparks;

b) it eliminates the need to purchase a separate pair of insulated gloves or mittens or waste time hunting for one; and c) it protects the user's hand from soot and grease.

Further objects and advantages will become apparent from a consideration of the drawings and ensuing description.

DRAWING FIGS.

Figure 1:
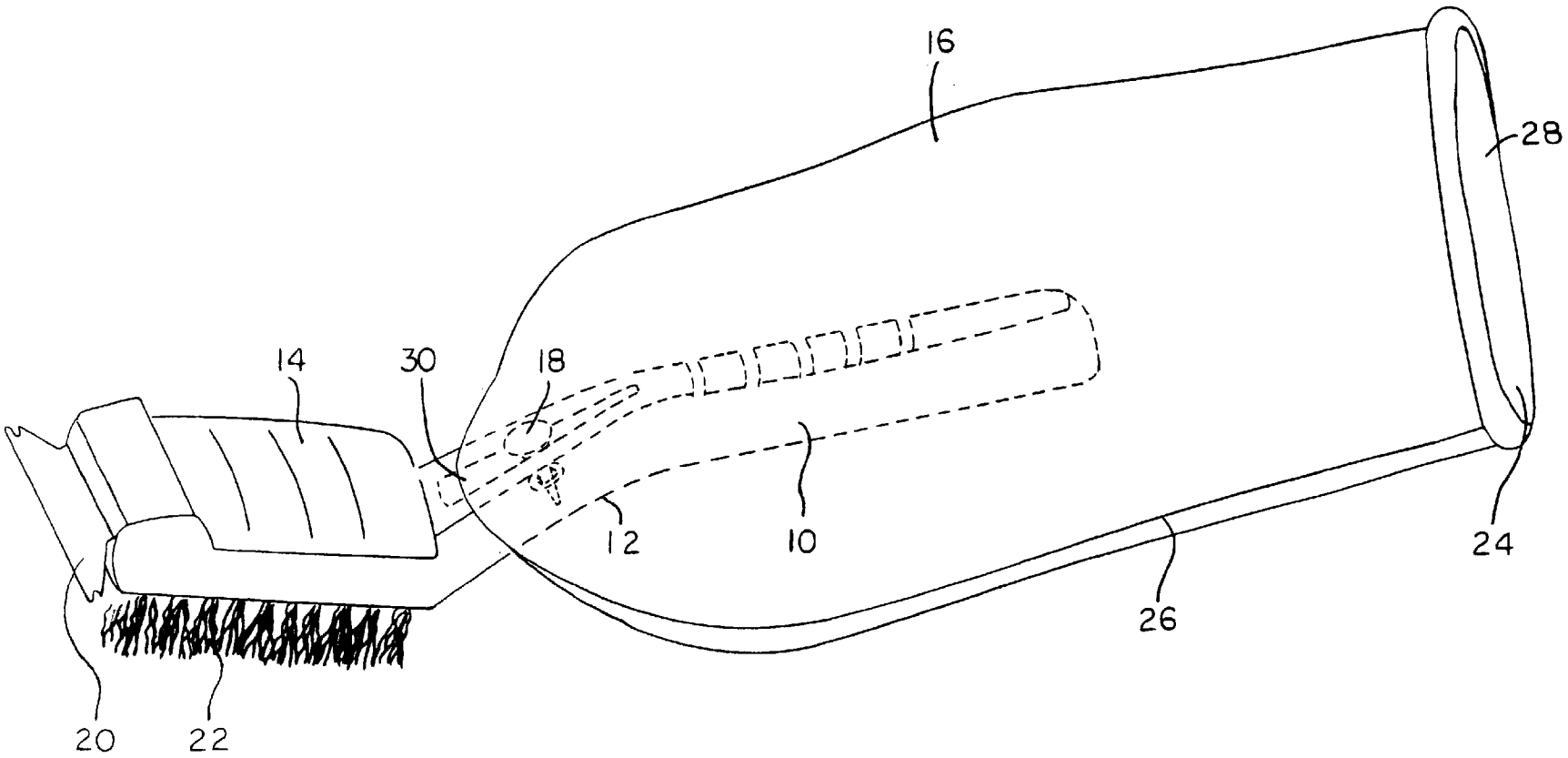
FIG. 1 is a perspective view of a combination barbecue grill brush and mitt embodying the invention.

| Reference Numerals In Drawings | |
|---|---|
| 10 hand grip | 12 intermediate section |
| 14 head section | 16 mitt |
| 18 rivet | 20 scraper |
| 22 bristles | 24 lining |
| 26 seam | 28 first end |
| 30 second end | 32 reinforcing collar |

SUMMARY

In accordance with the present invention a combination barbecue grill brush and mitt comprises a barbecue grill brush who's handle is secured within a protective mitt.

DESCRIPTION—FIGS. 1 TO 6

Figure 2:
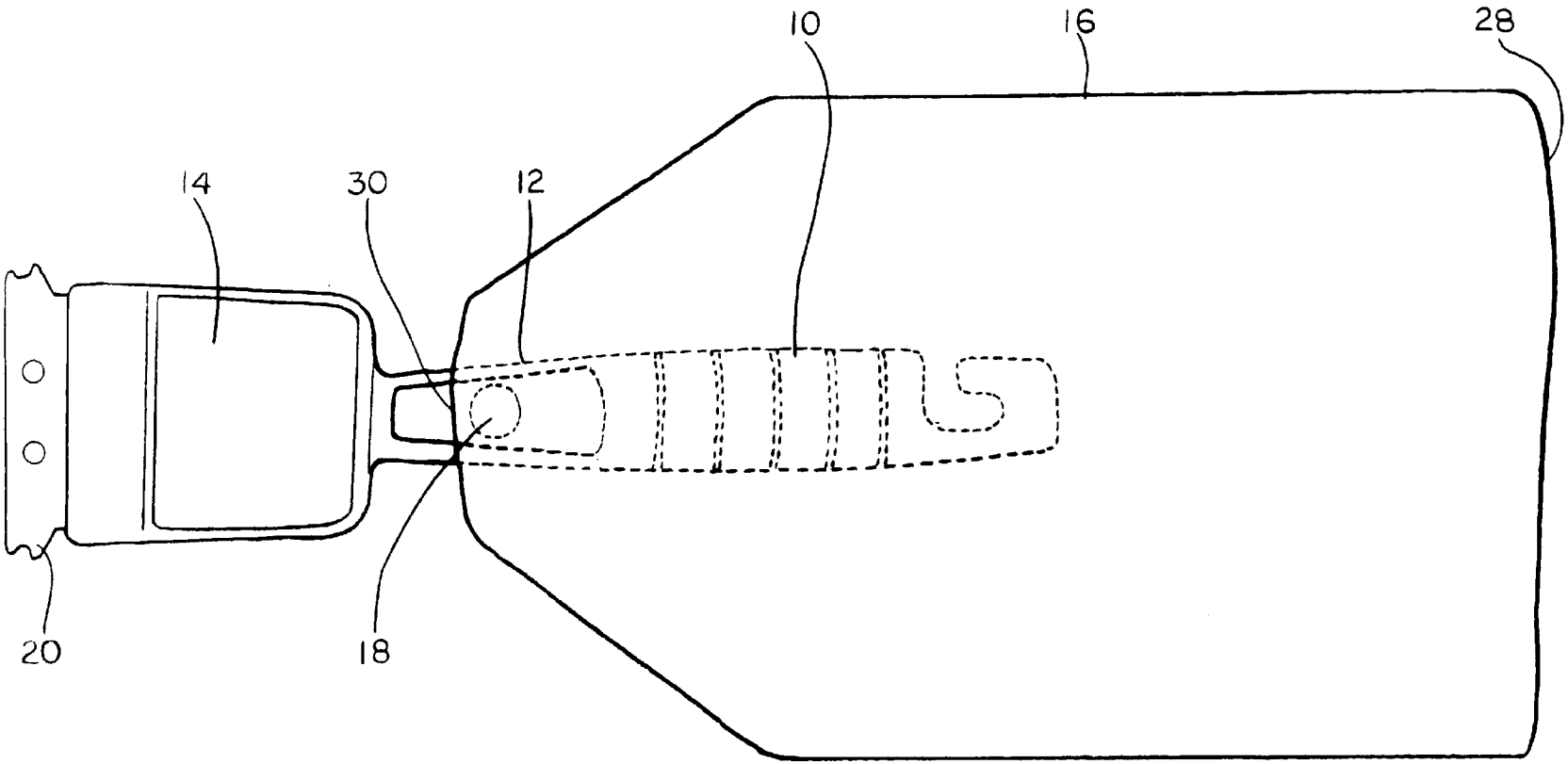
FIG. 2 is a top plan view of the brush and mitt of FIG. 1.
Figure 3:
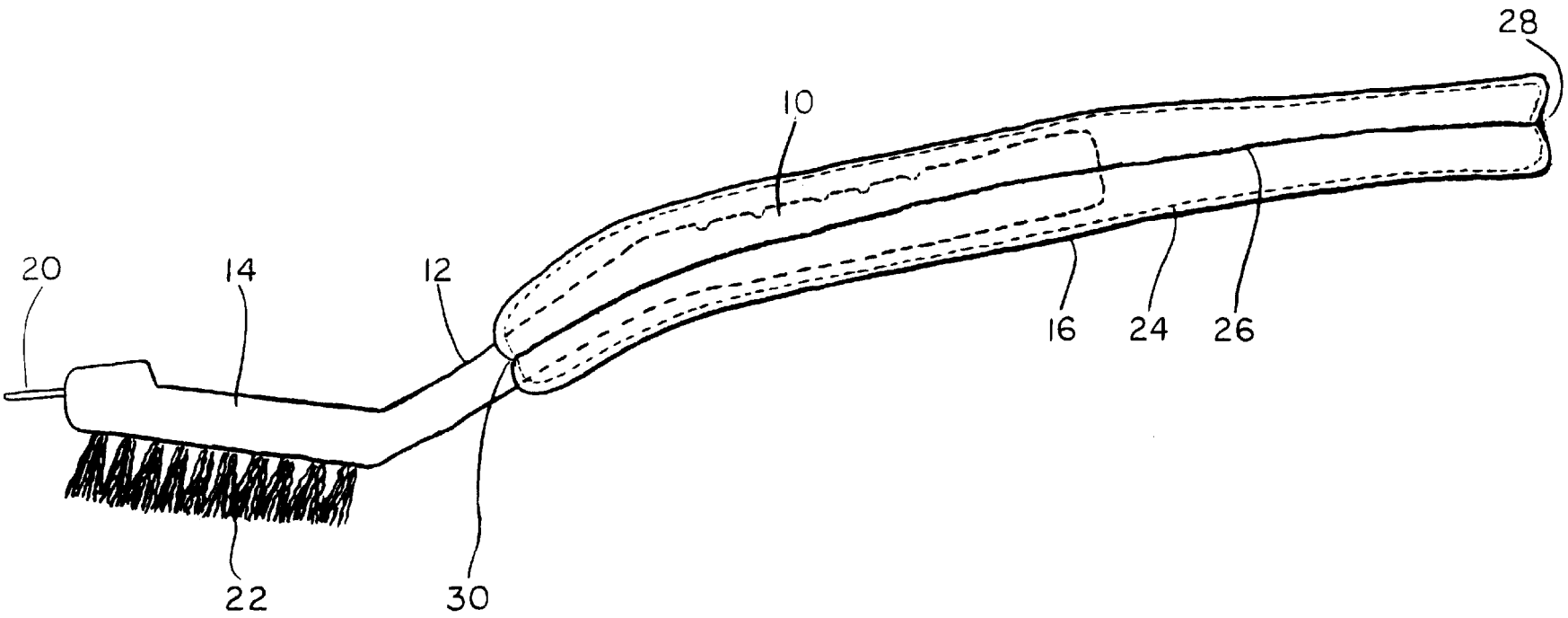
FIG. 3 is a side plan view of the brush and mitt of FIG. 1.
Figure 4:
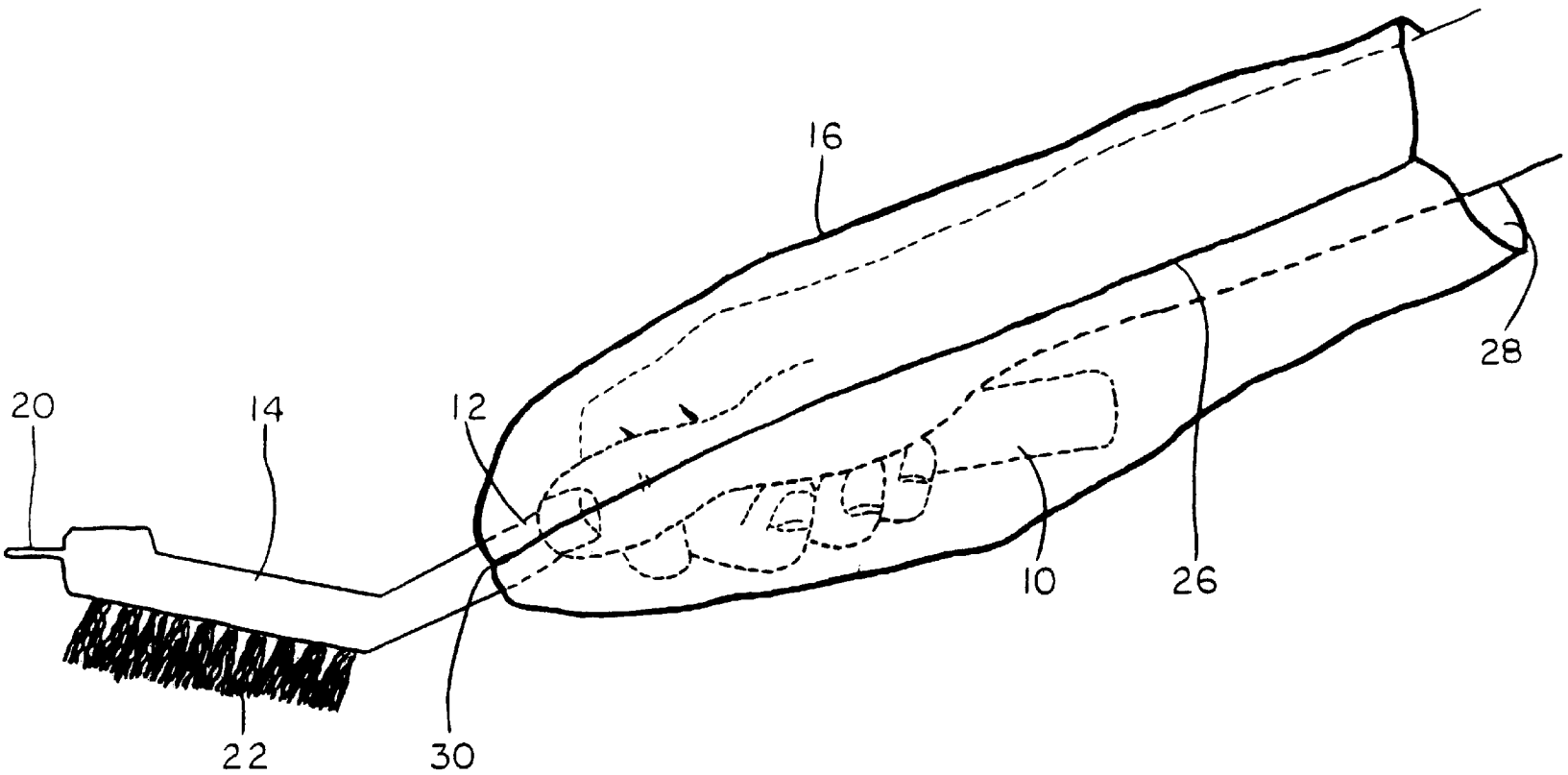
FIG. 4 is a side plan view of an embodiment of the brush and mitt of FIG. 1 in use.

The preferred embodiment of the combination grill brush and mitt is best illustrated in FIG. 1 (perspective view), FIG. 2 (top plan view), FIG. 3 (side plan view), and FIG. 4 (side plan view of the brush and mitt in use). FIGS. 1, 2, and 3 show a barbecue brush such as model G-100-12 sold by Rubbermaid of Wooster, Ohio. The grill brush comprises a one-piece hard plastic body with a hand-fitting hand grip 10, an intermediate section 12, terminating in a head section 14. A thin, flat steel scraper 20 protrudes from the end of head section 14. As seen in FIGS. 1 and 3, anchored to the underside of head 14 are rows of short, stiff brass bristles 22. It can also be seen that intermediate section 12 angles downward disposing head section 14 below hand grip 10.

FIGS. 1, 3, and 4 in particular, show a mitt 16 which is positioned about and envelopes hand grip 10. In the preferred embodiment, mitt 16 is made of leather such as #5 Red Ram glove splits available from United States Leather of Milwaukee, Wis. As will be obvious to those skilled in the art, mitt 16 is constructed from one or more pieces joined together to form a pouch typically with a seam 26 running down the length of each side. The mitt includes a first end 28 having an opening large enough to permit the insertion of a user's hand and a second end 30 which tapers to a blunt triangular shape, having an opening through which hand grip 10 is inserted. The mitt's inner surface is covered with a lining 24 (FIGS. 1 and 3).

Figure 5C:
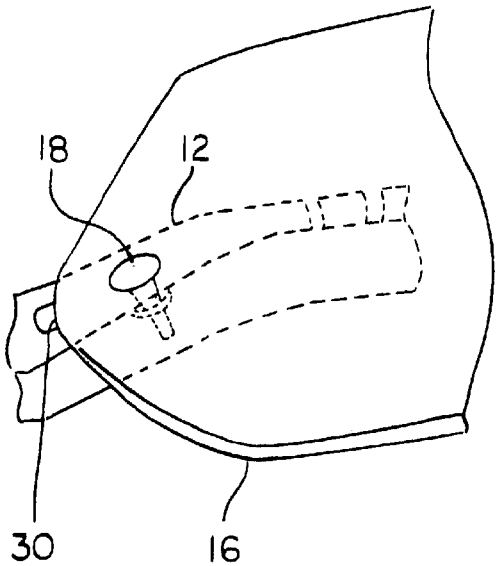
FIGS. 5A to 5C show perspective views of two embodiments for joining the mitt to the grill brush.
Figure 5B:
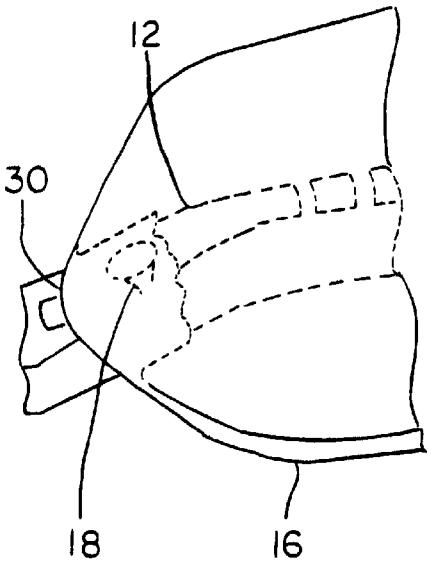
Figure 5A:
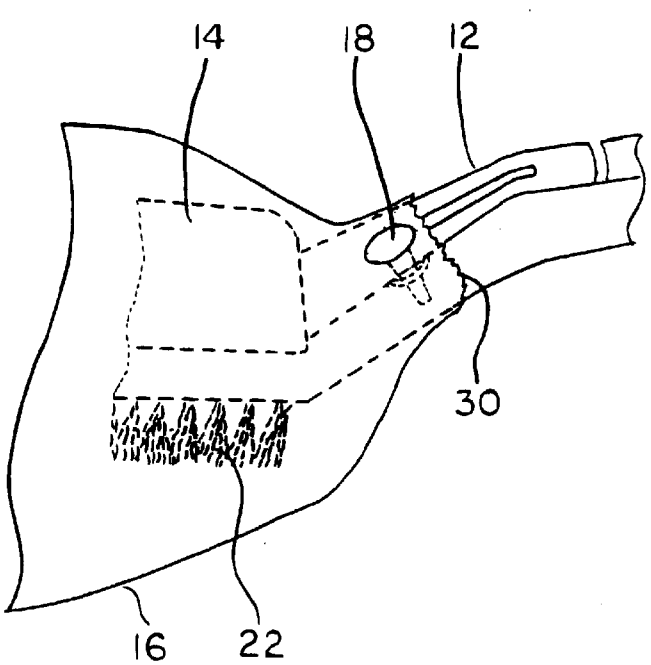

In the preferred embodiment, as seen in FIGS. 1 and 2, the second end's opening of mitt 16 is securely joined to intermediate section 12 of the grill brush with a rivet 18. Two methods of riveting the second end of the mitt to the intermediate section of the grill brush are shown in FIGS. 5A, 5B, and 5C. In FIG. 5A, the mitt is inside out where rivet 18 secures second end 30 to intermediate section 12. As seen in FIG. 5B the mitt was then turned right side out, thus leaving rivet 18 inside mitt 16. FIG. 5C differs only in that rivet 18 is installed from the outside of mitt 16 and remains visible. With either method, the mitt's second end is snugly secured around the intermediate section of the grill brush.

Figure 6:
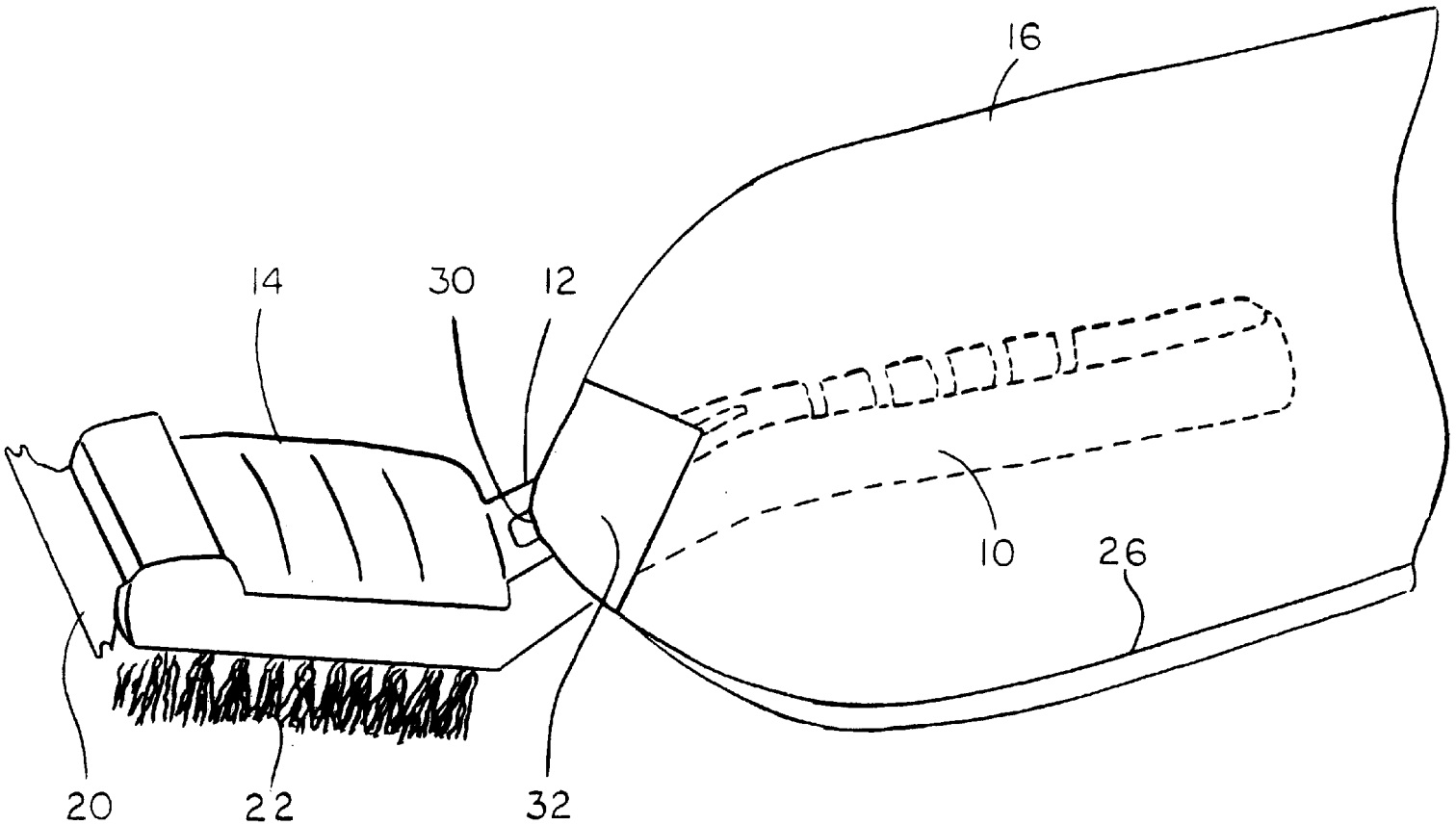
FIG. 6 shows a reinforcing collar that is secured around the handle at the second opening of the mitt.

In another embodiment, as shown in FIG. 6, a reinforcing collar 32 is secured around intermediate section 12 at second end 30 of the mitt.

OPERATION—FIG. 4

The manner of using the combination barbecue grill brush and mitt is identical to that of barbecue grill brushes in present use with the notable exception that the user's hand is enveloped within a heat-protective mitt. As shown in FIG. 4, the user first inserts his or her hand into the opening of first end 28 of the mitt and grasps hand grip 10 of the grill brush. Next, the user proceeds to clean the grill surface (not shown here) by brushing and scraping back and forth in the usual manner.

The function of all parts of the grill brush is the same as all prior art grill brushes.

The function of mitt 16, as shown in FIGS. 1 and 4, is to insulate the user's hand from the grill's intense heat. Lining 24 adds comfort and additional insulating value. The mitt's second end 30 tapers to the blunt triangular shape so the corners of the mitt don't drag along the grill's surface and become soiled. Rivet 18 secures the second end's opening of the mitt to the intermediate section of the grill brush forming a snug fit to substantially prevents hot gases, ash, and sparks from entering the mitt.

The function of collar 32, shown in FIG. 6, is to provide improved attachment of second end 30 to intermediate section 12 and to further prevent hot gases, ash, and sparks from entering the mitt.

SUMMARY, RAMIFICATIONS, AND SCOPE

Accordingly, the reader will see that the combination barbecue grill brush and mitt provides a familiar method for cleaning hot grill surfaces but with the clear advantage of the user's hand being protected from the intense heat generated by the grill.

While the above description contains many specificities, these should not be construed as limitations on the scope of the invention, but rather as an exemplification of one preferred embodiment thereof. It will be appreciated by those skilled in the art that additions, modifications, substitutions, and deletions not specifically described may be made without departing from the spirit and scope of the invention. For example, the brush body can be made of any structural material that retains its shape and resists heat such as wood, plastic, whether thermosetting or thermoplastic, reinforced or unreinforced, rubber, etc. The brush head can be different shapes and sizes, such as square, triangular, trapezoidal, etc. The brush head may or may not have a scraper which can be steel, aluminum, or other hard material that resists abrasion, fracture, and elevated temperatures. Brass bristles are preferred but other metals or non-metals that resist elevated temperatures can be used. The mitt can be made from any heat-resisting fabric such as synthetic leather, fiberglass, asbestos, wool, cotton, polybenzimidazole, polyetheretherketone, etc. The lining is optional, but can be made of many natural or synthetic fabrics. Using a rivet to secure the mitt to the brush is the preferred embodiment, but any number of methods can be used, such as clamps, adhesives, cinch straps such as rubber bands, plastic bands, heat-shrinkable wraps, etc. The attachment can be made from inside or outside the mitt. The grill brush can be permanently joined to the mitt or detachable.

Accordingly, the scope of the invention should be determined not by the embodiment illustrated, but by the appended claims and their legal equivalents.

What is claimed is:

1. A combination barbeque grill brush and mitt for the express purpose of protecting the user's hand and forearm from the heat generated from gas and charcoal grills while cleaning the grill surface comprising:

a grill brush with a body defining a hand grip at one end, and intermediate section, and a bristled head section at an opposite end;

a mitt having an inner surface, an outer surface, a first end having an opening to permit insertion of a hand within said mitt and a second end having an opening for insertion of said hand grip within said mitt, wherein said mitt is a loosely fitted insulated covering for the hand being made of flexible, compliant material that yields to the form of the user's hand including leather, wool, cotton, fabric, or synthetic fibers;

a means for securing said second end's opening of said mitt to said intermediate section of said body;

whereby said hand grip will be secured within said mitt.

2. A combination barbecue grill brush and mitt as in claim 1, wherein said body is made of any rigid material including wood, plastic, whether thermosetting or thermoplastic, reinforced or unreinforced, or rubber.

3. A combination barbecue grill brush and mitt as in claim 1, wherein said mitt is permanently secured to said body.

4. A combination barbecue grill brush and mitt as in claim 1, wherein said mitt is secured but detachable from said body.

5. A combination barbecue grill brush and mitt as in claim 1, wherein said means for securing said mitt to said body uses rivets, adhesive, clamps, cinch cords, heat-shrinkable bands, plastic bands, or rubber bands.

6. A combination barbecue grill brush and mitt as in claim 1, wherein said bristles are made of brass, other metals, or non-metals.

7. A combination barbeque grill brush and mitt as in claim 1, wherein the inner surface of said mitt comprises an inner lining made of a material which adds comfort or insulating properties to said mitt including duck cloth or flannel.

8. A combination barbeque grill brush and mitt as in claim 1, further comprising a collar secured to said mitt in surrounding relation to said second end's opening to said mitt causing said mitt to hug the outer surface of said intermediate section at said second end of said mitt to further prevent hot gases and sparks from entering said mitt through said second end's opening and to provide improved attachment of said mitt to the outer surface of said intermediate section of said body.

* * * * *